United States Patent [19]

Faulkner et al.

[11] 4,311,939

[45] Jan. 19, 1982

[54] ALKALI ANTIMONIDE LAYER ON A BERYLLIM-COPPER PRIMARY DYNODE

[75] Inventors: Richard D. Faulkner; Robert E. McHose, both of Lancaster, Pa.

[73] Assignee: RCA Corporation, New York, N.Y.

[21] Appl. No.: 132,659

[22] Filed: Mar. 21, 1980

[51] Int. Cl.[3] ..... H01J 40/00

[52] U.S. Cl. ..... 313/95; 313/98; 313/103 R; 313/104

[58] Field of Search ..... 313/94, 95, 98, 103 R, 313/104, 105 R

[56] References Cited

U.S. PATENT DOCUMENTS 2,574,356 11/1951 Sommer ..... 313/95 X 3,753,023 8/1973 Sommer ..... 313/94 X 4,112,325 9/1978 Faulkner ..... 313/95

4,160,185 7/1979 Tomasetti et al. ..... 313/94

*Primary Examiner*—Davis L. Willis

*Attorney, Agent, or Firm*—Eugene M. Whitacre; Dennis H. Irlbeck; Vincent J. Coughlin, Jr.

[57] ABSTRACT

An electron discharge tube comprises an evacuated envelope, a photocathode within the envelope and a primary dynode having an active portion substantially coplanar with the photocathode. The active portion of the dynode has an oxide secondary emitting surface. A substantially uniform layer of an alkali antimonide compound is formed on substantially all of the oxide secondary emissive surface of the dynode.

11 Claims, 2 Drawing Figures

ALKALI ANTIMONIDE LAYER ON A BERYLLIM-COPPER PRIMARY DYNODE

BACKGROUND OF THE INVENTION

The present invention relates to photomultiplier tubes and particularly to an improved secondary emission surface for a primary dynode.

Electron emissive electrodes are used in photomultiplier tubes to emit an electron in response to each impinging photon or a plurality of secondary electrons for each impinging primary electron. The primary electrons can be photoelectrons from a photocathode or secondary electrons from another dynode. The problem that has been encountered in the construction of phototubes has been to efficiently collect electrons emitted from one stage of the electron multiplier by another stage. In particular, the problem has been to maximize the collection of electrons at the input stage of the electron multiplier, i.e., photoelectrons from the photocathode to the first or primary dynode of an electron multiplier. An increase in the collection efficiency of electrons at the input stage increases the signal-to-noise ratio of the photomultiplier tube.

U.S. Pat. No. 4,112,325 to R. D. Faulkner, issued Sept. 5, 1978, and entitled, "An Electron Discharge Tube Having a Cup-Shaped Secondary Electron Emissive Electrode", describes a primary dynode having a relatively large area which provides a high collection efficiency for electrons emitted from the photocathode and incident thereon.

The collection efficiency of the above-described primary dynode may be improved by the addition of a focusing electrode disposed between the photocathode and the primary dynode for focusing photoelectrons emitted from the photocathode onto the primary dynode. Such a focusing electrode is described in the copending U.S. Patent Application, Ser. No. 65,842 by R. D. Faulkner et al., filed on Aug. 13, 1979, and assigned to the same assignee as the present patent application. The focusing electrode is also disclosed to focus secondary electrons emitted from the primary dynode onto the secondary dynode.

In many photomultiplier tube applications such as scintilation counting, for example, it is required that the output of the photomultiplier be linear with light input. Since the light energy of scintillations is directly proportional to the gamma ray energy over a certain range, an electrical pulse obtained from a photomultiplier tube is a direct measure of the gamma ray energy. Consequently, an important requirement of photomultiplier tubes used in scintillation counting is the ability to discriminate between pulses of various height. The parameter indicating the ability of a tube to perform this discrimination is called pulse-height resolution. The pulse-height resolution of a photomultiplier tube having a primary dynode such as that described in the Faulkner patent and in the copending Faulkner et al. application may be improved by increasing the secondary emission gain from the active area, i.e., the secondary emissive portion, of the primary dynode.

The secondary emission gain from a dynode is a direct function of the energy of the primary electrons incident on the dynode and also the composition and uniformity of the secondary emissive material. For example, oxidized beryllium copper dynodes typically have a secondary emission gain in the range of about 3 to 5 for a typical primary electron voltage range of about 100 to 200 volts. Other materials such as cesium-antimony on nickel dynode substrates are somewhat higher in secondary emission gain, ranging for example, from about 5 to 7 for primary electrons within the same 100 to 200 volt range. A photomultiplier tube having such a cesium-antimony dynode structure is described in U.S. Pat. No. 2,574,356 to Sommer, issued on Nov. 6, 1951, and entitled, "Process of Making Photoelectric Cathodes".

Significantly higher secondary emission gains in the range of 6 to 11 over the primary electron voltage range of 100 to 200 volts can be achieved using potassium, cesium, and antimony materials on a nickel dynode substrate. Such a structure is described in U.S. Pat. No. 3,753,023 to Sommer, issued on Aug. 14, 1973, and entitled, "Electron Emissive Device Incorporating a Secondary Emitting Material of Antimony Activated with Potassium and Cesium."

Since in most photomultiplier tubes, the number of stages usually range from 5 to 14, it follows that a small increase in secondary emission gain in the first stage will provide a large increase in the number of secondary electrons which reach the anode. Therefore, for similarly constructed photomultiplier tubes having an identical number of stages, the pulse-height resolution of a tube having a primary dynode with a relatively high secondary emission gain such as that provided by the alkali antimonides described in the above-mentioned Sommer's patents will be much greater than the pulse-height resolution of a tube using, e.g., an oxidized beryllium-copper dynode such as that described in the Faulkner patent and also in Faulkner et al. patent application cited above.

Where high secondary emission gain is desirable, potassium, cesium and antimony are often disposed on a nickel substrate to form a dynode. It is well known in the art, however, that problems are often encountered in evaporating antimony on nickel dynodes. Nickel has a tendency to alloy with antimony resulting in low secondary emission from dynodes formed from a nickel substrate and having an antimony layer activated by one or more alkali materials deposited thereon. Attempts to prevent this alloying, such as those described by C. M. Tomasetti et al. in U.S. Pat. No. 4,160,185 issued July 3, 1979, entitled, "Red Sensitivity Photocathode Having an Aluminum Oxide Barrier Layer", have been quite successful, however, the additional processing steps to prevent alloying of the nickel with the antimony increase the cost of the tube, and are, therefore, to be avoided if at all possible.

Uniformity of the secondary emission gain is also desirable in order to insure that the output of the photomultiplier tube remains linear regardless of where, on the primary dynode, the secondary electrons originate. For example, in the Sommer's patent (U.S. Pat. No. 2,574,356) the dynodes are disclosed to be of louvered, or "venetian blind", construction. Because of the angle of the louvers and the shielding provided by adjacent louvers, it is not possible to provide a sufficiently uniform layer of evaporated antimony on all parts of each louver. Accordingly, the secondary emission gain of the venetian blind dynode will be non-uniform.

Photomultiplier tubes have been produced by other manufacturers having oxidized beryllium-copper venetian blind dynodes and alkali antimonide photocathodes. In several of these tubes a single antimony evaporator is disposed between the faceplate and the dynodes, at about the center line of the tube. This evaporator location is selected in an attempt to provide a uniform antimony film on the faceplate for the subsequent formation thereon of a uniform photocathode. Of course, some antimony is also incidentally and unintentionally evaporated on the exposed surfaces of the first dynode and some antimony may also pass between the louvers in the first dynode to portions of the second dynode. Because of the shielding provided by the louvers, some portions of the dynodes will not receive any antimony and the resulting secondary emission surface formed on the dynodes will be non-uniform. The secondary emission gain variation from such a dynode surface will be so grossly non-uiform (i.e., highly position dependent) as to suggest the need for preventing the evaporation of antimony on oxidized beryllium-copper dynodes.

SUMMARY OF THE INVENTION

An electron discharge tube comprises a photocathode and a primary dynode. Said primary dynode has an active portion with an oxide secondary emissive surface thereon. A substantially uniform layer of an alkali antimonide compound is formed on substantially all of said oxide surface.

DESCRIPTION OF THE PREFERRED EMBODIMENT

Figure 1:
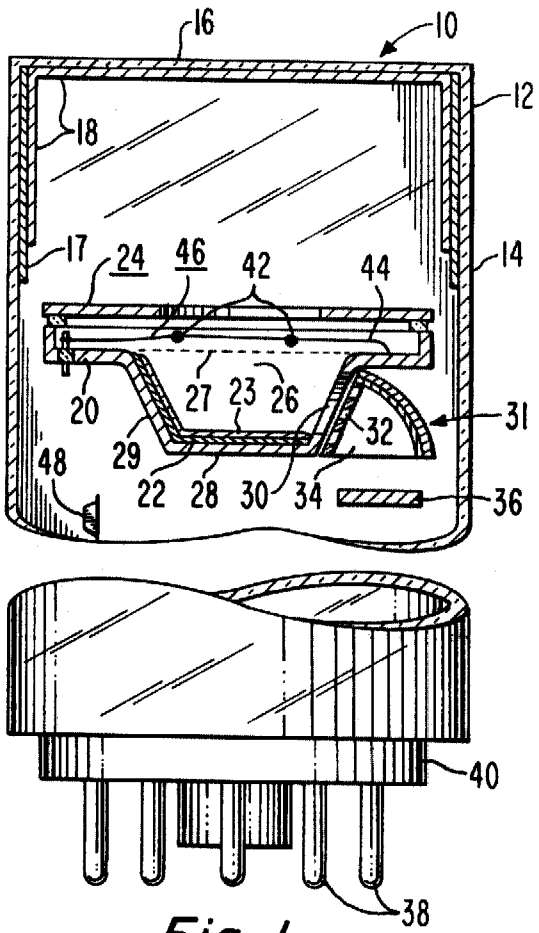
FIG. 1 is a partial cross-sectional view of the present novel photomultiplier tube.

Referring to FIG. 1, there is shown a photomultiplier tube 10 comprising an envelope 12 having a cylindrical sidewall 14 and a circular faceplate 16. An aluminizing coating 17 is disposed on a portion of the sidewall 14 adjacent to the faceplate 16. Within the tube 10 is a photocathode 18 on the faceplate 16 and also along a portion of the aluminized coating 17 on the sidewall 14. The portion of the photocathode 18 on the faceplate 16 is transparent while the portion of the photocathode 18 along the aluminized coating 17 is of a reflective type. The photocathode 18 may be potassium-cesium antimonide, for example, or any one of a number of photoemissive materials well known in the art. Inside the tube 10 is a primary or first teacup dynode 20 preferably of a beryllium-copper material having an active oxide secondary emissive surface 22 such as beryllium-oxide, for example, which faces the faceplate 16. A substantially uniform layer 23 of an alkali antimonide compound, such as potassium-cesium antimonide, overlies the coating 22. An apertured focusing electrode 24 is disposed in spaced relation between the dynode 20 and the (transparent portion of) photocathode 18 (on the faceplate 16). The dynode 20 is teacup shaped and has a substantially circular top opening or input aperture 26 covered by a planar mesh 27, a substantially flat base 28 substantially coplanar with the photocathode 18, and a generally frusto-conically curved sidewall 29 which connects the base to the periphery of the top opening 26. An output aperture 30 extends through a first region of the sidewall 29.

A box-like second dynode 31 acts as a receiving member for secondary electrons emitted from the teacup dynode 20. The dynode 31 has an input aperture 32 and an output aperture 34. Secondary electrons from the second dynode 31, passing through the output aperture 34, serve as primary electrons impinging upon an anode 36. While only two dynodes are shown in FIG. 1 for propagating and concatenating electron emission from the photocathode 18 to the anode 36, it is clear to one skilled in the art that a plurality of additional secondary dynodes may be included between the second dynode 31 and the anode 36. The total number of dynodes is governed, among other things by the final gain desired from the tube. The teacup dynode 20 and the box-like dynode 31 are described in detail in U.S. Pat. No. 4,112,325, referenced above and incorporated by reference herein.

The dynodes 20 and 31, the focusing electrode 24, the photocathode 18 and the anode 36 have conductive wires attached thereto for placing electrostatic charges thereon. The wires (not shown) terminate at the metal pins 38 located at the base 40 of the tube 10.

Disposed between the focusing electrode 24 and the planar mesh 27 are a plurality of platinum-antimony beads 42. The beads 42 comprise 50 percent platinum and 50 percent antimony and are affixed to wire filament 44 by a method well known in the art. Preferably, two beads 42 are attached to each filament 44 to form a platinum-antimony evaporator assembly 46. The evaporator assembly 46 acts as a line source, which distributes antimony along the length of the wire 44, rather than as a point source, which distributes antimony uniformity in all directions. To insure a uniformity of evaporation, two evaporator assemblies 46 (only one is shown) are mounted in each tube. While an ideal configuration would be to have the evaporator assemblies 46 disposed orthogonal to one another for more uniform evaporation of antimony, the assemblies may, in fact, be disposed in a skewed relationship to each other. A source of alkali material such as retainer 48 may be positioned within the envelope 12. The retainer 48 may contain a mixture of potassium chromate, cesium chromate, a reducing agent and a moderating agent. Such materials are well known in the art and need not be described. While only one retainer is shown, separate retainers may be used for each of the alkali materials. The alkali materials are used in the formation of the photocathode 18 and the layer of the alkali antimonide compound 23 on the primary dynode 20.

The secondary emission gain of the primary dynode 20 in the present novel structure is improved over the standard secondary emission surface, which in the case of a beryllium-copper dynode is beryllium oxide, by evaporating, in situ, a substantially uniform layer of antimony on the oxide coating 22 and activating this layer to form an alkali antimonide compound 23 thereon. It has been determined that an antimony layer having a thickness of about 1000 Å is desirable. By using an oxidized beryllium-copper teacup dynode 20 having a substantially flat, active surface as the substrate on which to evaporate the antimony layer, the problems of non-uniform evaporation of antimony on an active louvered surface and of alloying that frequently occurs between a nickel dynode substrate and an evaporated antimony layer is eliminated. Furthermore, since the oxidized beryllium-copper is already a secondary emissive material, it can be expected that any minor variation in the evaporated antimony layer and the resulting alkali antimonide compound will be supplemented by secondary emission from the underlying beryllium oxide secondary emissive surface.

The present novel structure lends itself to low cost, efficient manufacturing. Preferably the tube components are identical to the components used in the construction of the device described in the copending Faulkner et al. application referenced above. The antimony assemblies 46 are located so that antimony can be simultaneously evaporated on both the oxide surface 22 of the primary dynode 20 and on the interior surface of the envelope 12. By positioning the antimony assemblies 46 closer to the primary dynode 20 than to the faceplate 16, a layer of antimony having a thickness of about 1000 Å may be deposited on the dynode surface while a thinner film having a thickness of about 70 Å may be deposited on the faceplate 16. A heavier layer of antimony is required on the dynode 20 than on the faceplate 16 because the dynode layer must be capable of absorbing all the energy from incident photoelectrons having energies up to several hundred volts. Conversely, transmissive photocathodes such as photocathode 18 formed on faceplate 16 must be relatively thin so that photoelectrons created within the photocathode 18 can escape into the vacuum.

To simultaneously form the high gain alkali antimonide secondary emissive surface on the dynode 20 and the photocathode 18 on the faceplate 16, the tube is connected to an exhaust system (not shown). The tube is evacuated until the pressure in the envelope 12 is in the order of $10^{-6}$ torr or less. The tube 10 is then baked between 275°-400° C. for two to three hours to remove occluded gases from the interior tube components. The tube 10 is then cooled to room temperature.

While the tube 10 is at room temperature, antimony is simultaneously deposited on the interior surface of the envelope 12 including faceplate 16, and on the oxide secondary emissive surface 22 of the primary dynode 20. It has been determined that the aforementioned desired antimony thicknesses on the faceplate 16 and the dynode 20 may be achieved by monitoring the light transmission of the antimony evaporated onto the faceplate 16. This light transmission can be measured in the manner such as that disclosed in U.S. Pat. No. 2,676,282 to Polkosky. A light indicator (not shown) can be set to show a scale reading of 100 at full transmission of light through the faceplate 16. The evaporation of antimony from the antimony evaporator assemblies 46 is continued until the transmission through the faceplate 16 is preferably about 70 percent of its original value of 100 percent.

Potassium and cesium are then released into the evacuated envelope 12 for activation of the antimony film on the faceplate 16 and the antimony layer on the primary dynode 20. To release the aformentioned alkali materials the retainer 48 is heated to a sufficiently high temperature to evaporate the substances contained therein. The retainer 48 may be heated by passing a current therethrough or by an external rf electrode. The tube 10 is then baked in an oven (not shown) at a temperature of approximately 180° C. until the photosensitivity reaches a peak and the electric leakage decreases to a predetermined value. The tube 10 is then slowly cooled at a rate of about 5°-10° C. per minute to approximately 70°-80° C. at which temperature the tube is allowed to cool freely to room temperature. After the tube 10 is removed from the exhaust system and the exhaust tubulation (not shown) is sealed, the tube 10 is operative.

In the preferred embodiment described above the oxide secondary emitted surface 22 of primary dynode 20 is a beryllium oxide secondary emitting surface. However, aluminum oxide and magnesium oxide will also provide satisfactory oxide secondary emitting surfaces. It should further be appreciated that while the primary dynode base material was described as being beryllium-copper, other materials on which an oxide secondary emitting surface can be deposited can also be used. Such other base materials include nickel and alloys with a silver or copper matrix.

Photomultiplier tubes made in accordance with the described method have been measured to have a pulse-height resolution of typically 9.3 percent and tubes having a pulse-height resolution as low as 8.8 percent have been produced. In contrast, photomultiplier tubes produced using a standard beryllium oxide secondary emitting layer on the primary dynode typically have a pulse-height resolution of 9.8 percent.

Figure 2:
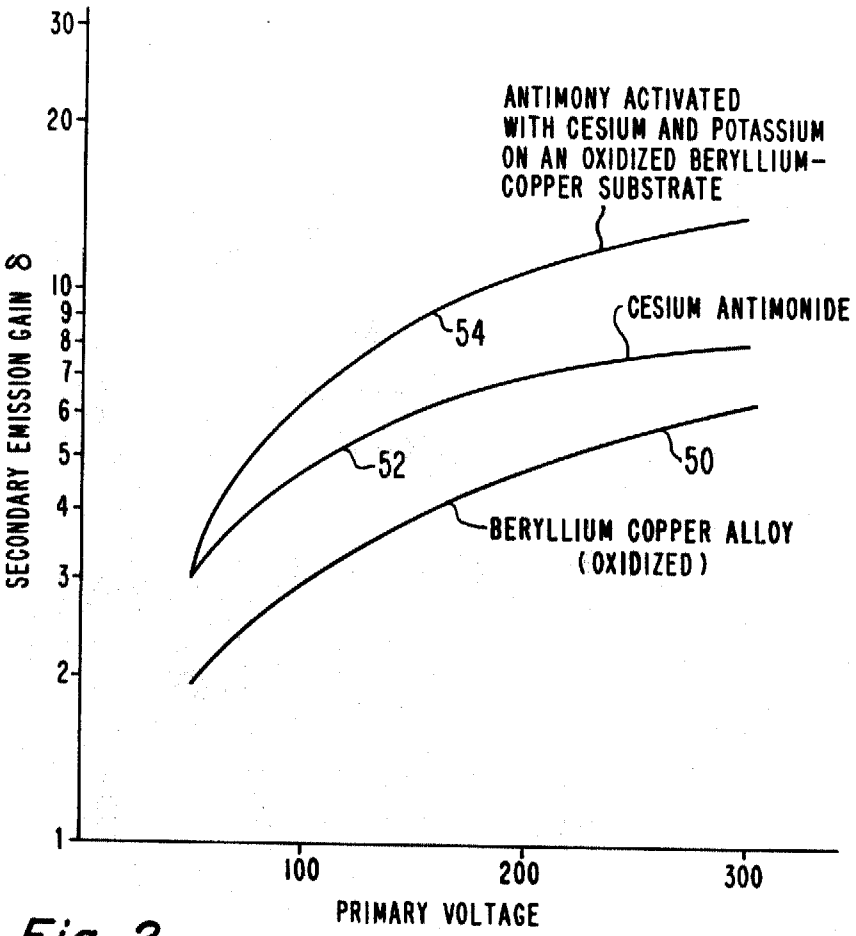
FIG. 2 is a graph showing the general relative secondary emission properties of various secondary electron emitting materials, including the emitting materials of the dynode of FIG. 1.

FIG. 2 shows a curve of the comparative secondary emission gains of a layer consisting essentially of antimony activated with potassium and cesium deposited on a beryllium oxide surface. Gain curves for two other secondary emissive materials mentioned above with respect to the background of the invention are also included. The curves 50, 52 and 54 shown are for oxidized beryllium-copper alloy, cesium antimony ($Cs_3Sb$), and antimony activated with potassium and cesium, respectively.

What is claimed is:

1. An electron discharge tube comprises:
an evacuated envelope;
a photocathode within said envelope;
a primary dynode having an active portion with an oxide secondary emitting surface thereon;
a substantially uniform layer of an alkali antimonide compound formed on substantially all of said oxide secondary emitting surface;
at least one secondary dynode spaced from said primary dynode; and
an anode adjacent to said secondary dynode.

2. The tube as in claim 1 wherein the active portion of said primary dynode is substantially coplanar with said photocathode.

3. The tube as in claim 1 wherein the oxide secondary emitting surface is a material selected from the group consisting of beryllium oxide, magnesium oxide and aluminum oxide.

4. The tube as in claim 1, wherein said alkali antimonide compound includes a base layer of antimony deposited, in situ, on said oxide secondary emitting surface of said dynode, and said photocathode includes a base film of antimony deposited, in situ, on an interior surface of said envelope.

5. The tube as in claim 4, wherein said base layer of antimony on said oxide surface is about 1000 Å thick.

6. The tube as in claim 2, wherein said portion of said primary dynode substantially coplanar with said photocathode is substantially flat.

7. The tube as in claim 1, wherein said primary dynode is a teacup dynode.

8. The tube as in claim 4, wherein said base film of antimony on said interior surface of said envelope is about 70 A thick.

9. The tube as in claim 4, further including antimony evaporation means disposed between said photocathode and said primary dynode for depositing said antimony layer on said oxide secondary emitting surface of said primary dynode, and said base film of antimony on said interior surface of said envelope.

10. The tube as in claim 9, wherein said antimony evaporation means includes a plurality of platinum-antimony beads for simultaneously depositing said antimony layer on said primary dynode and said base film of antimony on said interior surface of said envelope.

11. The tube as in claim 4, wherein said alkali antimonide compound further includes cesium and potassium.

* * * * *